US005569976A

United States Patent [19]

Gavrilov et al.

[11] Patent Number: 5,569,976

[45] Date of Patent: Oct. 29, 1996

[54] ION EMMITER BASED ON COLD CATHODE DISCHARGE

[76] Inventors: Nikolai V. Gavrilov, Cherepanova St. 24, Apt. 229, 620034 Ekaterinberg; Sergey P. Nikulin, Vikoolova 43, Bldg. 3, Apt. 80, 620131 Ekaterinburg, both of Russian Federation

[21] Appl. No.: 490,208

[22] Filed: Jun. 14, 1995

[51] Int. Cl.[6] ..... H01J 61/09

[52] U.S. Cl. ..... 313/359.1; 313/231.31; 313/231.41; 313/631

[58] Field of Search ..... 313/359.1, 362.1, 313/363.1, 230, 231.31, 231.41, 618, 631, 632

[56] References Cited

U.S. PATENT DOCUMENTS 3,831,052 8/1974 Knechtli ..... 313/618

5,132,597 7/1992 Goebel et al. ..... 313/359.1

5,483,121 1/1996 Okagaki et al. ..... 313/618

*Primary Examiner*—Sandra L. O'Shea

*Assistant Examiner*—Vip Patel

*Attorney, Agent, or Firm*—Gilliam, Duncan, & Harms

[57] ABSTRACT

The emitter includes hollow cylindrical cathode, which has a multi-apertured emission window at one end, and a coaxial rod-shaped anode at the other end, mounted with a feed-through insulator. A magnetic coil is mounted coaxially on the outside of the cathode and creates a magnetic field. The cathode has an internal open chamber or space filled with a gas and with the applying of a voltage between the cathode and anode the gas discharge starts. The ions are extracted from the gas discharge plasma through the emission window.

6 Claims, 1 Drawing Sheet

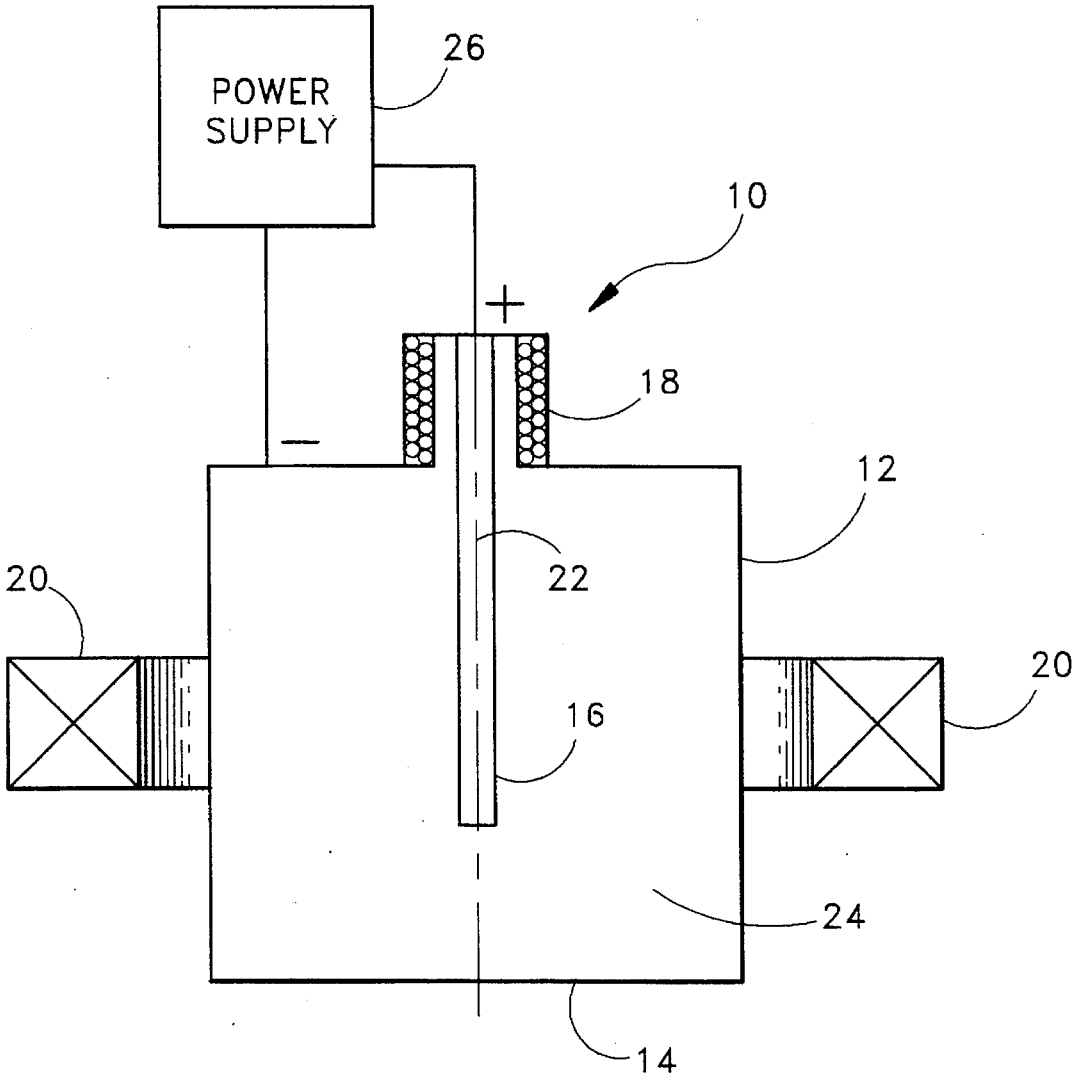
POWER SUPPLY
26
10
+
18
−
12
22
20
20
16
24
14

ION EMMITER BASED ON COLD CATHODE DISCHARGE

FIELD OF THE INVENTION

The proposed invention relates to the technique of plasma creation and the generation of intense ion beams with large cross-sectional area.

BACKGROUND OF THE INVENTION

There are known plasma emitters of charged particles based on a glow discharge at low gas pressures, where strong magnetic fields of the order of $10^{-2}$–$10^{-1}$ Tesla (T) are produced to decrease the operating pressure and increase the plasma density. Those plasma emitters are used to produce narrow, highly focused beams in the systems based on the reflection discharge, and ring beams in the systems, based on the magnetron discharge. However, applying a strong magnetic field creates a significant spatial non-uniformity in the generated plasma, which makes difficult the generation of beams with large cross-sectional area in such systems.

The generation of the uniform plasma in a large volume at low pressure is provided by the discharge with hollow cathode without applying a magnetic field. To sustain a stable discharge it is necessary that the length of the energy relaxation of the fast electrons, oscillating inside the hollow cathode would be comparable with their mean path before escaping from the cavity, which is provided by increasing the size of the system and decreasing the area of electron loss. The electron loss area equals the sum of the emission aperture area and the elements inside the system, which have positive potential with reference to the cathode.

The known ion emitters of this type consist of the hollow cathode with a multi-apertured emission window and a rod-shaped anode mounted inside the cathode. However, the ignition of such a discharge at low gas pressure is quite difficult because the ignition voltage of such a discharge is significantly higher than its operating voltage. That leads to the necessity for a special ignition system to provide for the increased voltage between the electrodes, or the creation of an initial plasma injected into the system to start the main discharge. That makes the design of the system and its power supply more complicated, and reduces the reliability of the whole device. Further, the operating parameters of the beams generated in such systems are limited, since, for the small sized internal volume under the conditions for the self-sustaining discharge, it is necessary to increase the consumption of gas, which reduces the electric strength of the accelerating gap, and, consequently, the operating voltage of the ion source; an increase in the size of the system at low pressures leads to the decrease of the plasma density and a corresponding decrease of the value and density of the emission current.

SUMMARY OF THE INVENTION

The purpose of this invention is to increase the gas efficiency and reliability of the device with the same ion emission current density and uniformity of the current density.

The solution of this task is achieved by the following elements: a known plasma emitter, a rod-shaped anode, and the hollow cathode with the multi-apertured emission window through which the ion beams exit therefrom. The emission window is located at one end of a cylindrical hollow cathode, and there is a magnetic coil, mounted coaxially on the outside of the cathode. With the proposed design of the emitter of the invention, it is not necessary to either inject an initial plasma into the internal volume of the hollow cathode or increase the voltage between the cathode and anode in order to start the discharge. Stable ignition is possible at lower gas pressures in comparison with the prior art designs, by applying a voltage between cathode and anode. This is achieved by the superposition of the magnetic field, which prevents the loss of the fast electrons to the anode. It has been confirmed experimentally that the optimum magnetic field for the ignition and sustaining of the discharge for all gases used in the experiment is approximately $10^{-3}$ T when the cavity diameter is equal to 15 cm and, changes approximately inversely proportionally to D. At lower values of the magnetic field, the loss of the electrons increases, and at higher values significant noise and plasma instabilities appear, reducing its uniformity. The reduction of the anode diameter helps to decrease the loss of electrons but is limited by the heat removal condition. With the length (L) ratio of the internal cavity 24 within the range of 0.8 to 1.2 of the cavity diameter, and the length (l) ratio of the rod-shaped anode 22 within the range of 0.5 to 0.8 of the length (L), a high emission current density is obtained at low gas pressure. The gas efficiency becomes poorer with shorter cathodes because of the higher gas pressure, and with longer cathodes because of the decrease of emission current. With the condition $l<0.5$ L the sustaining of the discharge becomes difficult and the emission current decreases; at $l>0.8$ L, the non-uniformity of the emission current density increases. The proposed plasma ion emitter has high reliability and gas efficiency because of the described features.

Other features of the invention will become apparent as the drawing which follows is understood by reading the corresponding description thereof.

BRIEF DESCRIPTION OF THE DRAWING FIGURE

Details of the invention, and of certain preferred embodiments thereof, will be further understood upon reference to the cutaway drawing showing the invention.

DETAILED DESCRIPTION OF THE PREFERRED EMBODIMENT

The cold cathode ion emitter 10 includes the hollow cylindrical cathode 12, which has a multi-apertured emission window 14 at one end, and a coaxial rod-shaped anode 16 at the other end, mounted in a feed-through insulator 18. A magnetic coil 20 is mounted coaxially along the longitudinal center line 22 on the outside of the cathode 12.

The dimension ratios of the components of the invention are as follows: L=(0.8 to 1.2) D; l=(0.5 to 0.8) L , where L is the length of the cathode open chamber 24, D is the diameter of the cathode open chamber 24, l is the length of the rod-shaped anode 22. Ideally, the ratios are L=D and l=0.65 L.

OPERATION OF THE PREFERRED EMBODIMENT

The work of the proposed plasma ion emitter 10 can be described as follows: the current going through magnetic coil 20 creates a magnetic field inside the open chamber (cavity) 24 of the cylindrical cathode 12. It has been found that a magnetic field in the range of approximately $10^{-3}$ T is ideal (the exact field strength depending on cavity dimensions wherein the magnetic field changes approximately inversely proportionally to D). The cavity is filled with a gas, as for example $C_3H_8$, $N_2$, $NH_3$, Ar, $O_2$ and any other gas suitable for the intended purpose, and on applying the voltage from power supply 26 between the cathode 16 and anode 12, the gas discharge starts; ions are extracted from the discharge plasma through the emission window 14.

Testing was accomplished in a pulsed power regime from power supply 26 with continuous gas feed into the cathode cavity 24 with a diameter of 150 mm. The anode having a diameter of 3 mm, and the anode having a length of 100 mm. The pulse length from the power supply 26 was $2\times10^{-3}$ sec and the repetition rate of approximately 25 Hz. The pulse ion emission current was 0.4 A over the emission area of 200 $cm^2$.

The gas pressure in the chamber was approximately $10^{-2}$ Pa, while in prior art, the pressure necessary for a stable discharge was approximately $10^{-1}$ Pa, and the lower pressure of approximately $5\times10^{-2}$ Pa and could only be reached using a significant increase of the cathode length (up to 0.8 m). Ignition and sustaining of the discharge were provided by the same power supply with an open circuit voltage of up to 1.8 kV. The operating voltage of the discharge was varied in the range 500–900 V, depending on the gas supplied, the pressure and the cathode temperature. The magnetic field of coil 20 was approximately 10–3 T. The non-uniformity of the emission current density distribution was not more than 8%.

The use of the proposed plasma ion emitter 10 in ion sources will allow decreased gas pressure and ignition voltage compared to the prior art and, consequently, will allow the use of higher acceleration voltages and an increased reliability of the device due to the simple design of the source itself and its power supply, and significantly improve the operating characteristics.

Other applications, variations and ramifications of this invention will occur to those skilled in the art upon reading this disclosure. Those are intended to be included within the scope of this invention, as defined in the appended claims.

We claim:

1. A cold cathode plasma emitter for producing ions comprising:

a cylindrical cathode having an internal cavity with a first and second end with an ion emission window at said first end, said cavity containing a plasma producing gas, said cathode dimensions selected from the following ratios: L/D=0.8 to 1.2; L is the length of said internal cavity and D is the diameter of said internal cavity;

a rod-shaped anode, mounted coaxially with the center line of said cavity positioned within the cavity, said anode length l selected from the following ratio I/L=0.5 to 0.8;

a pulse power supply connected to said cathode and an anode;

a feedthrough insulator positioned between said cathode and said anode for electrical insulation therebetween; and a magnetic coil, mounted externally of the cathode and coaxially with said longitudinal center line of said cavity for producing a magnetic field.

2. The invention as defined in claim 1 wherein said plasma producing gas is selected from the group of gases consisting of $C_3H_8$, $N_2$, $NH_3$, Ar and $O_2$.

3. The invention as defined in claim 1 wherein said plasma producing gas is pressurized between $_{10}^{-2}$ and $_{10}^{-1}$ Pa.

4. The invention as defined in claim 1 wherein the open circuit voltage of said power supply is to 1.8 kV with a pulse width from 10 microseconds up to continuous mode.

5. The invention as defined in claim 1 wherein the optimal cavity ratio is L=D and l=0.65 L.

6. The invention as defined in claim 1 wherein said magnetic coil has a magnetic field of approximately $10^{-3}$ T when D=15 cm, said magnetic field changing approximately inversely proportionally to D.

* * * * *